US007216371B2

(12) United States Patent
Wong

(10) Patent No.: US 7,216,371 B2
(45) Date of Patent: May 15, 2007

(54) JOCK SUPPORT SHORT

(75) Inventor: Jon G. Wong, Long Beach, CA (US)

(73) Assignee: EZ Gard Industries, Inc., Plymouth, MN (US)

( * ) Notice: Subject to any disclaimer, the term of this patent is extended or adjusted under 35 U.S.C. 154(b) by 170 days.

(21) Appl. No.: 11/034,203

(22) Filed: Jan. 12, 2005

(65) Prior Publication Data

US 2005/0204458 A1 Sep. 22, 2005

Related U.S. Application Data

(60) Provisional application No. 60/536,021, filed on Jan. 12, 2004, provisional application No. 60/536,087, filed on Jan. 12, 2004, provisional application No. 60/536,020, filed on Jan. 12, 2004.

(51) Int. Cl.
*A41D 13/02* (2006.01)

(52) U.S. Cl. ..... 2/228

(58) Field of Classification Search ..... 2/227, 2/228, 238, 455, 456, 465, 69, 404, 400, 2/407, 22, 23, 403; 602/70–72
See application file for complete search history.

(56) References Cited

U.S. PATENT DOCUMENTS

| | | | | |
|---|---|---|---|---|
| 1,830,572 | A | | 11/1931 | Taylor |
| 3,176,686 | A | | 4/1965 | Barnes |
| 3,229,692 | A | | 1/1966 | Creed |
| 4,134,400 | A | | 1/1979 | DiMatteo |
| 4,257,414 | A | | 3/1981 | Gamm et al. |
| 4,453,541 | A | | 6/1984 | Castelli et al. |
| 4,660,554 | A | | 4/1987 | Wright |
| 4,870,958 | A | * | 10/1989 | Webster ..... 602/67 |
| 4,967,768 | A | | 11/1990 | Tatro |
| 4,989,594 | A | | 2/1991 | Doherty et al. |
| 5,274,854 | A | | 1/1994 | Wenner et al. |
| 5,479,942 | A | | 1/1996 | DiMatteo |
| 5,819,323 | A | * | 10/1998 | Edenfield ..... 2/466 |
| 5,920,914 | A | * | 7/1999 | Dempsey ..... 2/403 |
| 6,041,441 | A | * | 3/2000 | Counts et al. ..... 2/227 |
| 6,048,327 | A | | 4/2000 | Kieffer |
| 6,319,219 | B1 | | 11/2001 | Landi |
| 2003/0163076 | A1 | | 8/2003 | Lukens |
| 2004/0024341 | A1 | | 2/2004 | Jacobs |

FOREIGN PATENT DOCUMENTS

| | | |
|---|---|---|
| CA | 1 290 098 | 10/1991 |

OTHER PUBLICATIONS

U.S. Appl. No. 11/034,235, filed Jan. 12, 2005, Wong.

* cited by examiner

*Primary Examiner*—Tejash Patel
(74) *Attorney, Agent, or Firm*—Faegre & Benson, LLP

(57) ABSTRACT

In one embodiment, the present invention provides a jock support short including a short member and an integrally-formed jock support member. The integral jock support member includes a pocket portion attached to a front portion of the short, which is configured to house a protective groin cup. At least two elongate members extend along opposing sides of the pocket portion and may intersect or meet at a crotch portion of the short such that the pocket and/or protective cup remains secured over a user's groin region during athletic or other physical activity.

21 Claims, 10 Drawing Sheets

JOCK SUPPORT SHORT

CROSS-REFERENCE TO RELATED APPLICATIONS

The present application claims priority to U.S. Provisional Application Ser. No. 60/536,021 entitled "Chin Cup," Ser. No. 60/536,087 entitled "Jock Cup," and Ser. No. 60/536,020 entitled "Supporter Briefs," each of which was filed on Jan. 12, 2004, and is hereby expressly incorporated by reference in its entirety.

BACKGROUND

Protective cups and other devices for the protection of the male groin region are utilized during athletic competition, as well as for certain non-athletic occupations and activities where users are susceptible to impacts to the groin region.

One conventional method of securing a protective cup against the user's body to protect the groin region from impact is disclosed in U.S. Pat. No. 4,134,400. This device utilizes a jock strap that includes a pouch for holding the protective cup over the groin region. The pouch is closed at one end where it is connected to straps that extend downwardly from the waistband and is open at an upper end where the inner layer of the pouch is connected to the waistband. Fasteners positioned at the opening of the pouch close the pouch to secure the cup in the pouch in position on the body.

Conventional jock straps generally provide only one body gripping aperture, the elastic waistband, to hold the supporter and relatively heavier protective cup in place. For small boys in particular, whose waist and pelvic-hip region are very small, a single body gripping aperture is not enough to hold a supporting device plus protective cup in place. For others, including men who are large around the waist, it may be uncomfortable to have a single tight fitting body aperture around the waist. Additionally, strap twisting may create discomfort and make it difficult to put on the jock strap. Further, while conventional jock straps hold the protective cup generally in place, they tend to be cumbersome and uncomfortable.

An alternative to the jock strap is an athletic support short, which secures a protective cup over the groin region of a user without the use of jock-type straps, and may be comfortably worn as outerwear or under other clothing or equipment. These athletic support shorts may include a releasably closeable pouch to receive a protective cup, such as the shorts reported in U.S. Pat. No. 3,788,314 to Noreen. Although generally more comfortable than conventional jock straps, current athletic short designs may fail to properly secure the protective cup in the most comfortable and protective position over the user's groin, and the protective cup may be become dislodged from its proper positioning when the user moves. Additionally, impact to the genital area may cause the protective cup to be pushed out of position, thereby increasing vulnerability to impact. Further, such movement of the cup may cause the edge of the cup to contact areas of the groin area, potentially causing considerable pain or injury.

Therefore, it would be beneficial to provide a jock support device possessing the comfort provided by a short with the level of protection afforded by conventional jock-straps.

SUMMARY OF THE INVENTION

In one embodiment, the present invention provides a support short including a short member and an integral jock member. The short member generally includes front and rear portions which are integrally formed to define a waist portion and first and second leg portions.

The integral jock member includes a pocket portion attached to the front portion of the short member which is adapted to house a protective cup adjacent the groin of a user. The integral jock member further includes two elongate members which extend downwardly along opposing sides of the pocket portion, between the first and second leg portions and along the rear portion of the short. The elongate members may restrict movement of the pocket portion relative to the short member in order to retain a protective cup adjacent the groin of a user.

In certain embodiments, the elongate members may be formed as a pair of straps that extend along the front portion of the short member between the waist portion and a crotch portion and on opposing sides of the pocket portion. The straps may further meet and/or intersect at the crotch portion and then extend generally upwardly along the rear portion of the short.

In another embodiment, the elongate member may form an "X" type configuration in which the top legs of the "X" extend along the front of the short member on opposing sides of the pocket portion, the bottom legs of the "X" extend along the rear of the short member, and all four legs intersect in the crotch portion of the short member.

In an alternate embodiment, the present invention provides a jock support short including a short member having first and second leg portions and a pocket portion attached to the first and second leg portions. The jock support short further includes means for restricting movement of the pocket portion relative to the first and second leg portions.

In a further embodiment, the jock support short may include an outer short member, an inner short member and an integral jock support member. The outer short member may be formed from a generally loose-fitting or compression-type material. The jock support member may be integrally attached to the inner short member such that the pocket portion and elongate members are formed on an inside surface of the short. Elongate members may alternatively or additionally be formed on the outer short member as well.

DETAILED DESCRIPTION

Figure 1:
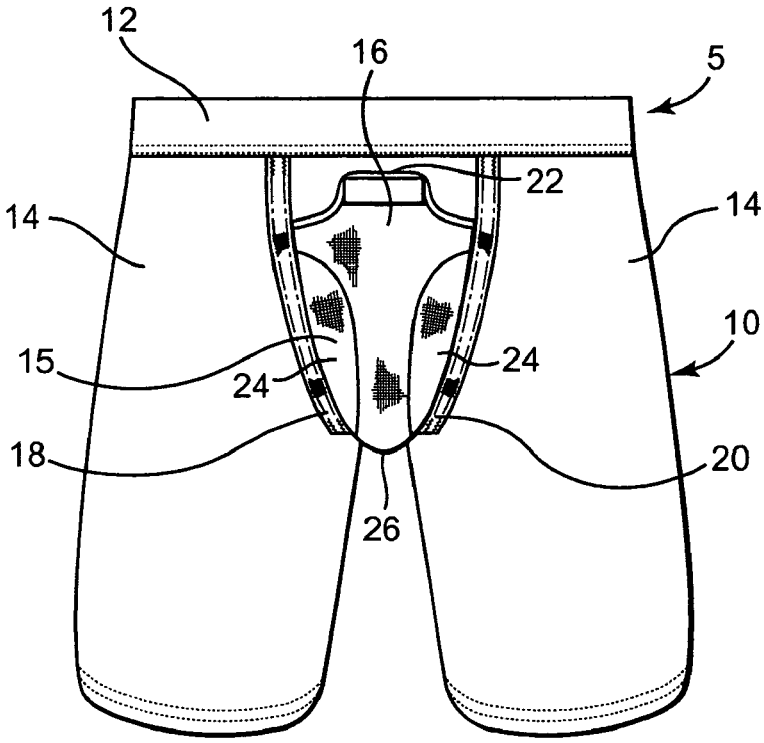
FIG. 1 illustrates a front view of a support short according to an embodiment of the present invention.

FIG. 1 shows a frontal view of a support short 5 of the present invention which includes a short member 10 having a waistband 12, and front fabric panels 14. A jock support member 15 is disposed in between the front fabric panels and includes a pocket portion 16 for holding a protective cup, and a pair of elongate members 18, 20 extending along opposing sides of the pocket portions.

The pocket portion 16 includes a top 22, and vertical sides 24 which generally meet to form the bottom 26 of the cup. The top 22 of the pocket portion 16 may include a closure device, such as Velcro, buttons, zippers and the like to allow for closure of the top 22 yet still provide an opening for insertion of a protective cup. In an embodiment of the present invention, the pocket portion 16 is sized to accommodate a protective cup yet reduce the ability of the cup to shift within the pocket portion 16.

Figure 2:
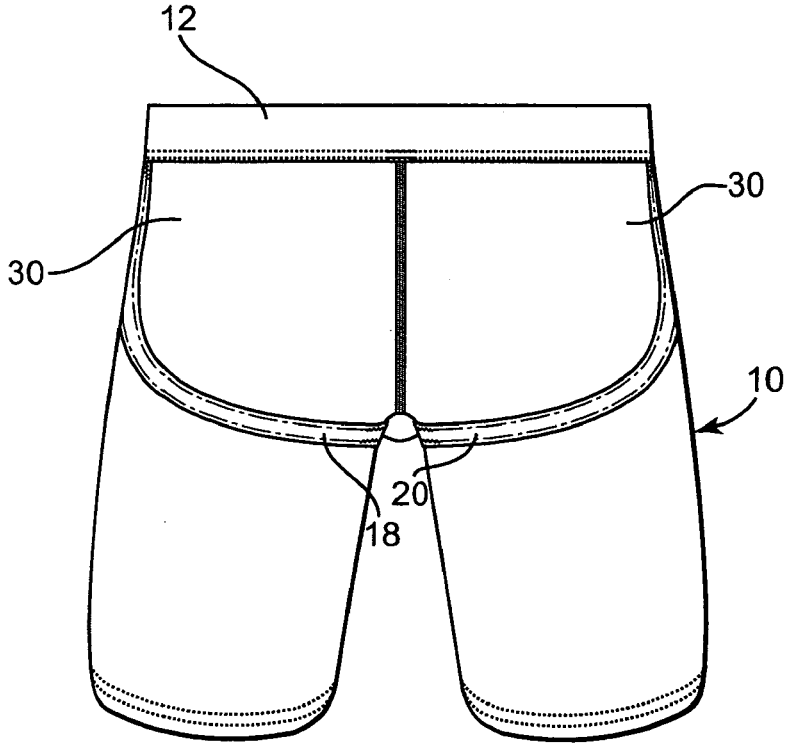
FIG. 2 illustrates a rear view of the support short shown in FIG. 1.
Figure 3:
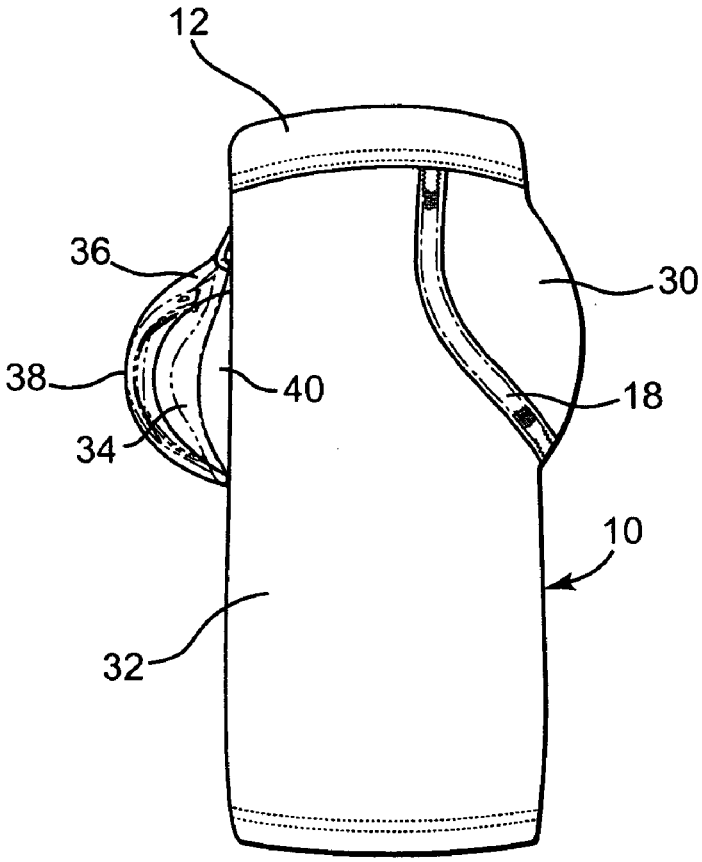
FIG. 3 illustrates a side view of the support short shown in FIG. 1.

FIG. 2 shows a rear view of support short 10 including waistband 12, rear fabric panels 30, and portions of the elongate members 18, 20 illustrated in FIG. 1. FIG. 3 shows a side view of the support short 10 illustrated in FIGS. 1–2, which also illustrates waistband 12, side fabric panel 32 and portions of the member 18. FIG. 3 further shows the pocket portion 16 including a protective cup 34 disposed within a space 36 formed between a front pocket panel 38 and a rear pocket panel 40, which are secured together to form the pocket portion 16. The rear pocket panel 40 may include a padding layer disposed between the cup 34 and a user's groin.

The pocket portion 16 is adapted to house a variety of protective cups 34. An example of a suitable protective cup is reported in the U.S. patent application entitled "Impact Protection Device" (attorney docket number 73893-311877), which was filed concurrently with the present application and is hereby expressly incorporate by reference in its entirety.

Figure 4:
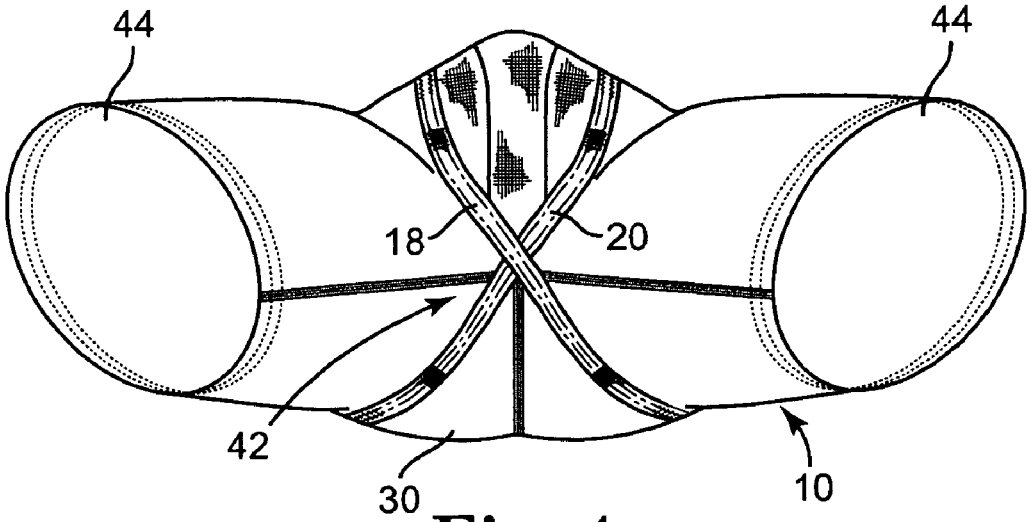
FIG. 4 illustrates a bottom view of the support short shown in FIG. 1.

FIG. 4 shows a bottom perspective view of a crotch portion 42 of the support short 10 formed between leg openings 44, 44. The elongate members 18, 20 intersect and/or meet at the crotch portion 42 and continue along the rear and/or side panels 30, 32 of the support short 10 as shown in FIGS. 2 and 3. In alternate embodiments, the elongate members 18, 20 may pass through but not intersect at the crotch portion 42.

Figure 5:
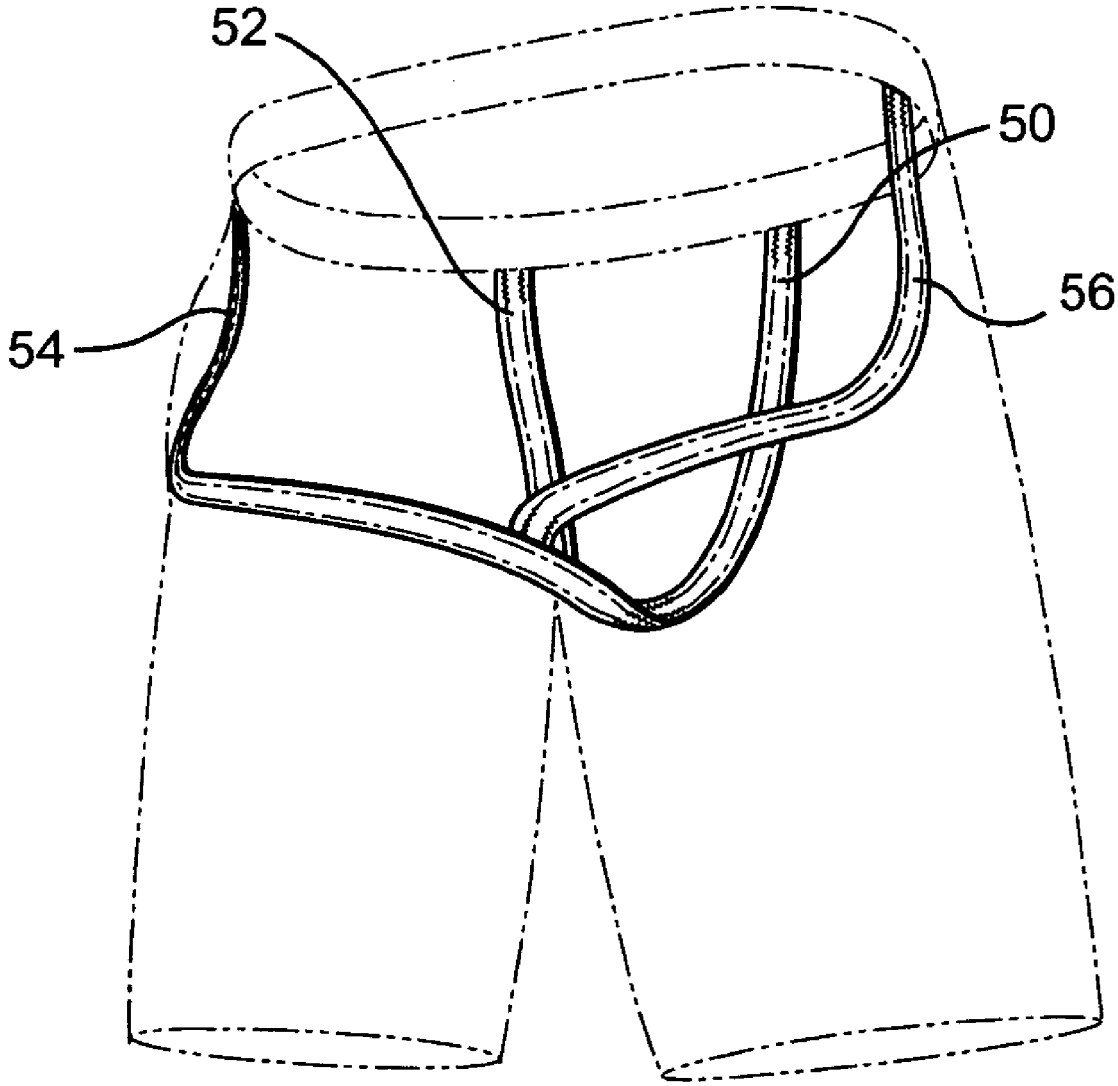
FIG. 5 illustrates a perspective view of the support short shown in FIG. 1.

As exemplified in FIG. 5, the elongate members 18, 20 are generally positioned about the support short 10 to pass between the user's legs and to follow the contours of the user's groin and buttocks regions to increase the contact of the cup 34 over the user's groin region, particularly during body movement. In this manner, the elongate members 18, 20 function similarly to a jock strap. However, because the elongate member 18, 20 are integrally attached to the short member 10, strap twisting experienced with conventional non-integrated straps is eliminated.

As further shown in FIG. 5, the elongate members 18, 20 may form an "X" configuration around the short member 10, with top legs 50, 52 attached to the waistband 12, front panels 14 and/or the pocket portion 16, and the bottom legs 54, 56 attached to the rear fabric panels 30 and/or waistband 12. As noted with respect to FIG. 4, the legs 50, 52, 54 and 56 meet, pass and/or intersect at the crotch portion 42 to complete the "X" configuration.

The elongate members 18, 20 may be formed in several ways. In the illustrated embodiment, the elongate members 18, 20 are formed by two discrete straps that attach at waistband 12, extend downwardly along opposing sides of cup portion 16, cross at the crotch portion 42, and then extend upwardly along the rear and/or sides of the short member 10 to the waistband 12. Alternatively, the straps could be attached to the inside surface of support short 10. In either case, the straps may be integrally attached to the short member 10 by a conventional zigzag stitch.

The straps may be formed from a variety of materials. In one embodiment, the straps are formed from a material having suitable elasticity and/or resiliency to apply tension to the user's body when worn, similar to conventional jock straps.

Instead of using straps, the elongate members 18, 20 could be formed by integrally stitching one or more elastic and/or tension threads along the general path shown by the elongate members 18, 20 in FIGS. 1–5 such that a tension force is applied to the user's body along the path of the elongate members 18, 20.

Although a variety of configurations may be used, the elongate members 18, 20 apply a tensioning, tightening, and/or compression-type force to restrict movement of the pocket portion 16 relative to the short member. This may help to retain a protective cup housed in the pocket portion 16 during use.

The short member 10 may be formed from a variety of materials. In one embodiment, the short member 10 may be at least partially formed from a compression-type material in order to fit snugly to the user's body. Suitable materials of this type include various mixtures of nylon, polyester, cotton and spandex. The material may also have moisture wicking capabilities, and/or may be formed partly or completely into a mesh to provide improved ventilation to the user. In one embodiment, particular panels of material, particularly in the region of a user's groin, are formed from a compressible mesh material. Alternatively, the short member 10 may be formed at least partially from a non-compression, loose fitting material, for example, a loose fitting mesh material.

The waistband 12 may be formed from a variety of suitable materials, and may include an elastic strip to provide a tension fit about the waist of a user. In an alternate embodiment, the waistband may include a drawstring or the like. In a further embodiment, the waistband may include adjustment members such as Velcro-type flaps to manually tighten or loosen the waistband 12 about a user's waist (See FIG. 9).

The various components of the support short 5 may be sewn together in a conventional manner. For example, the short member 10 illustrated in FIG. 1, may be formed from 2 basic fabric pieces sewn together with a surge seam or a similar seam. A third fabric piece may be sewn to the 2 basic fabric pieces to form the pocket portion 16. The elongate member 18, 20 may be used to secure these fabric pieces together, or may be attached after the support short 10 has been configured. Thus, although the illustrated embodiment is described as having front, rear and side panels for convenience, such panels may or may not be formed from the same piece of materials. Of course, it will be readily appreciated that a range of approaches could be used to form the support short 5.

Figure 6:
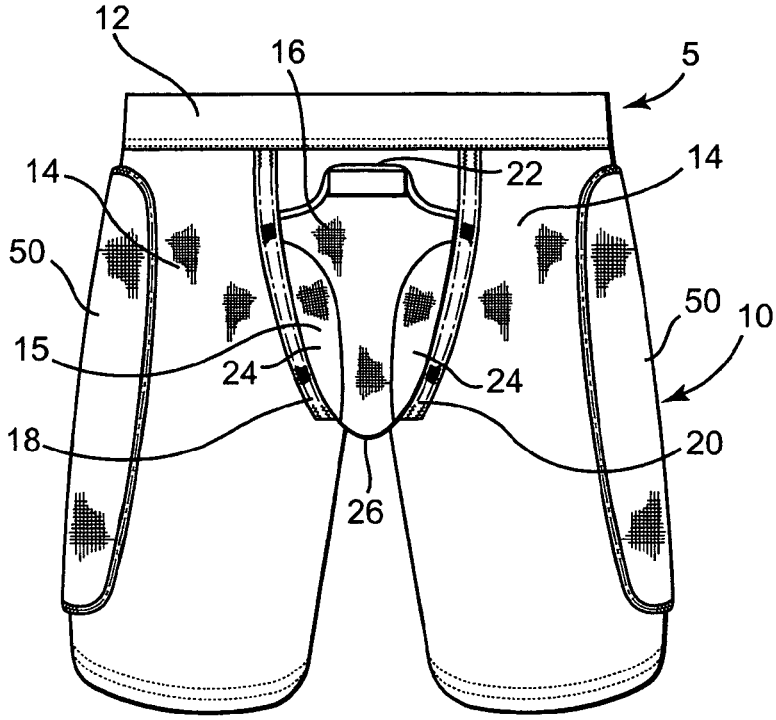
FIG. 6 illustrates a front view of a support short according to an embodiment of the present invention.
Figure 7:
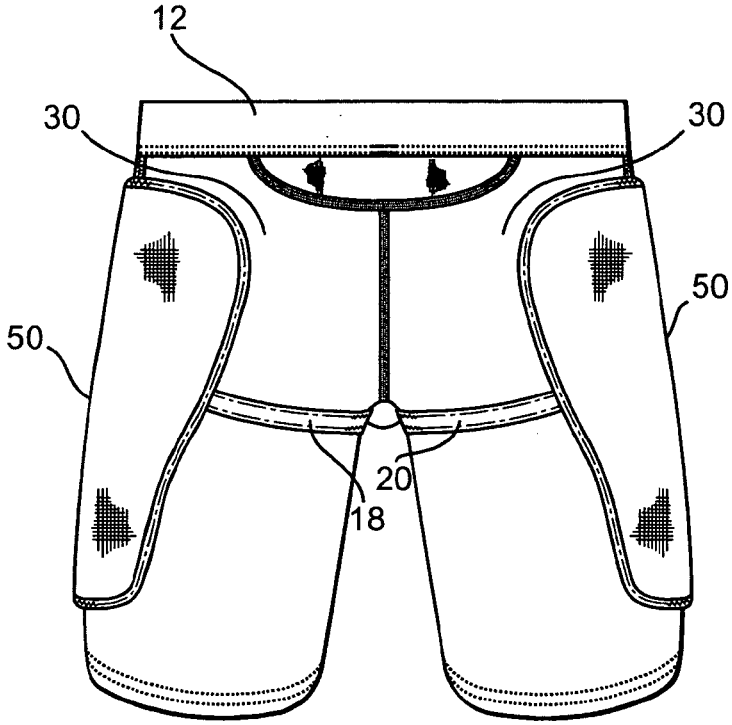
FIG. 7 illustrates a rear view of the support short shown in FIG. 6.
Figure 8:
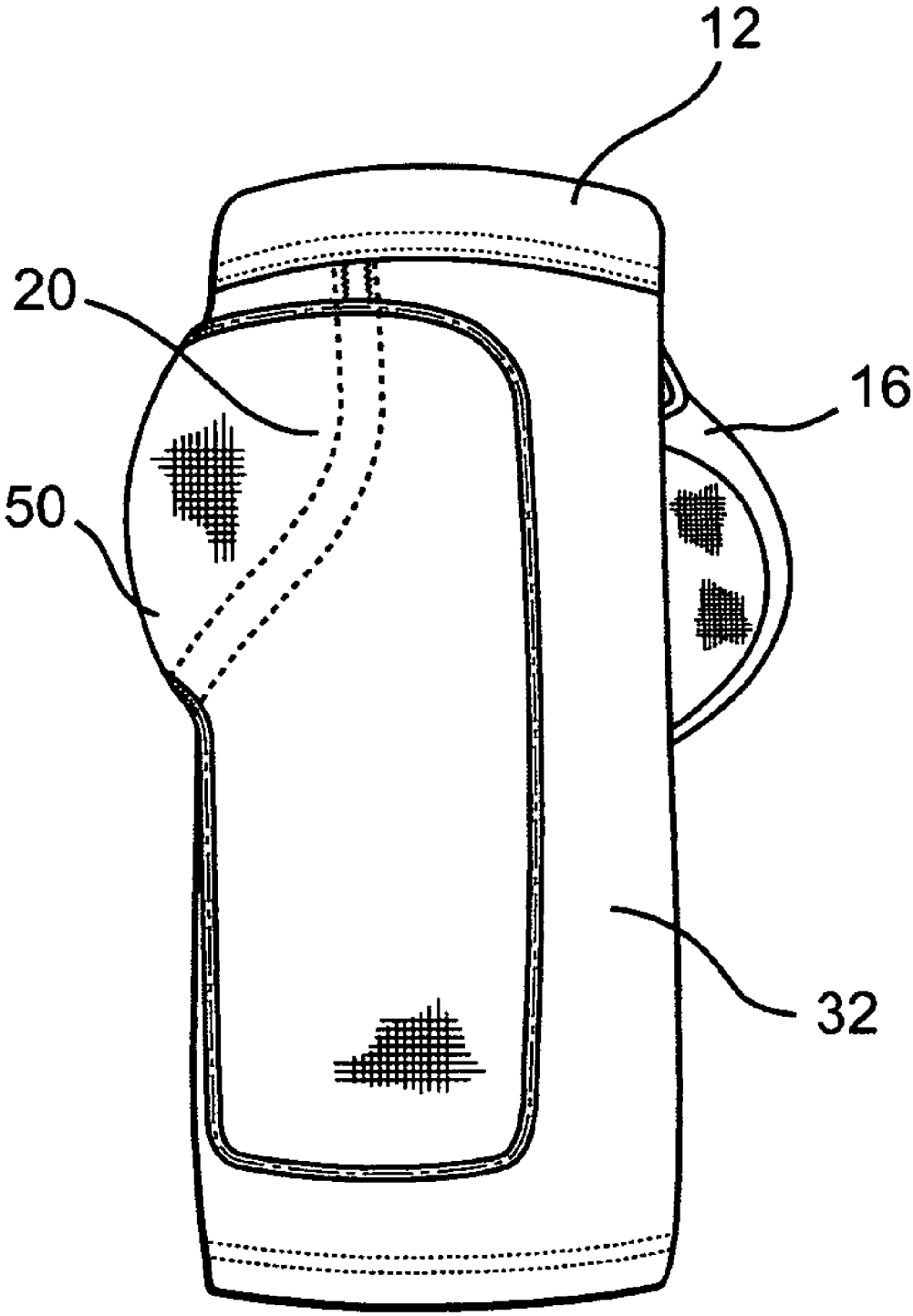
FIG. 8 illustrates a side view of the support short shown in FIG. 6.

FIGS. 6–8 show respective front, rear and side views of an alternate embodiment of the present invention, which includes padding members 50, 50. The padding members 50, 50 may be attached to either an inside or outside surface of support short 10, and may provide additional protection during, for example, a baseball, softball, soccer or football game. As shown in particular in FIG. 8, the elongate members 18, 20 extend underneath the padding members 50, 50 to secure the cup 34 over the user's groin region.

Figure 9:
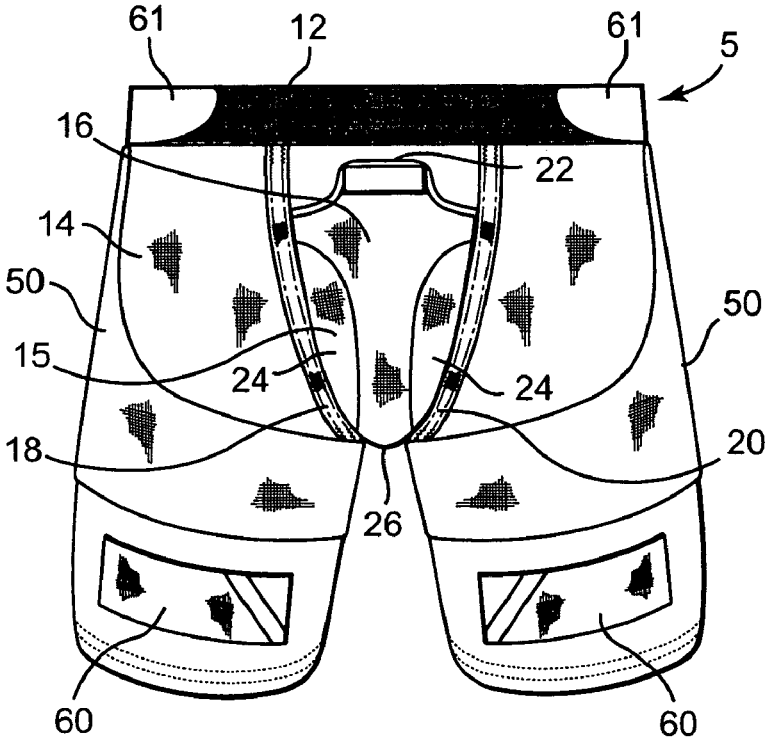
FIG. 9 illustrates a front view of a support short according to an embodiment of the present invention.
Figure 10:
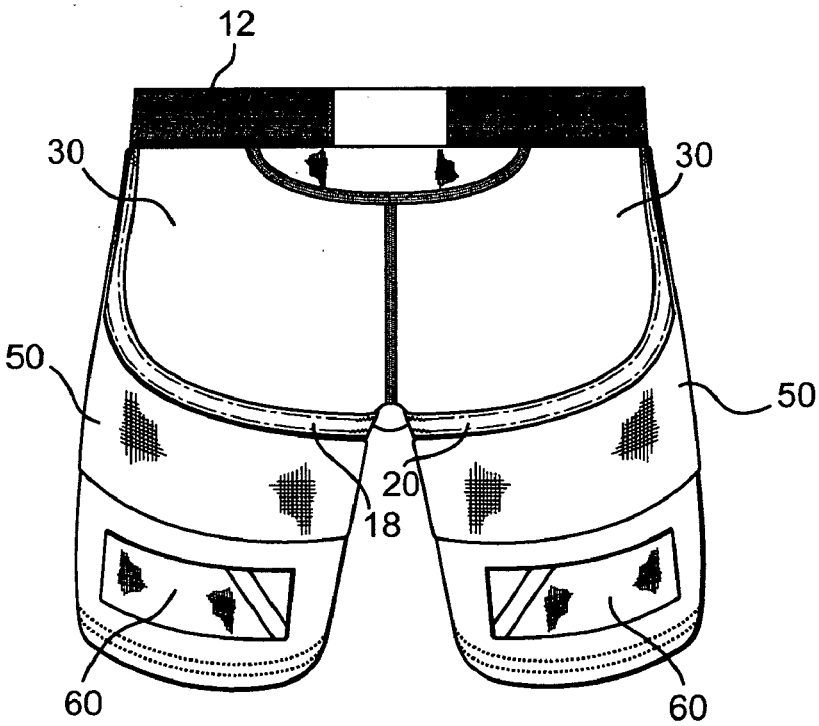
FIG. 10 illustrates a rear view of the support short shown in FIG. 9.
Figure 11:
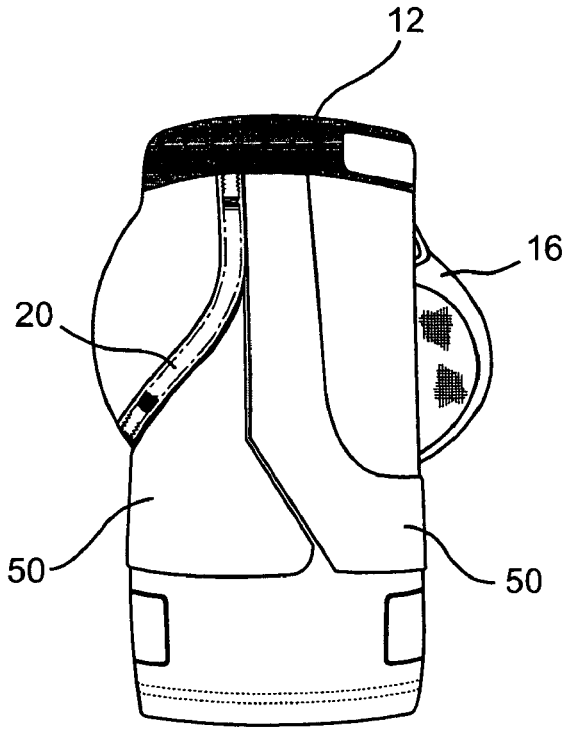
FIG. 11 illustrates a side view of the support short shown in FIG. 9.

FIGS. 9–11 show another embodiment of the present invention which may be particularly useful as hockey shorts. In addition to the features described with reference to FIGS. 1–8, the embodiment illustrated in FIGS. 9–11 includes a plurality of hockey sock supports 60 for supporting hockey socks. The sock supports 60 may include a Velcro-type flap for folding over the hockey socks. The waistband 12 also includes several Velcro-type attachments 61 for adjusting the tension of the waistband 12. Additionally, the padding members 50, 50 are shaped to provide extra protection to a user during hockey games.

Figure 12:
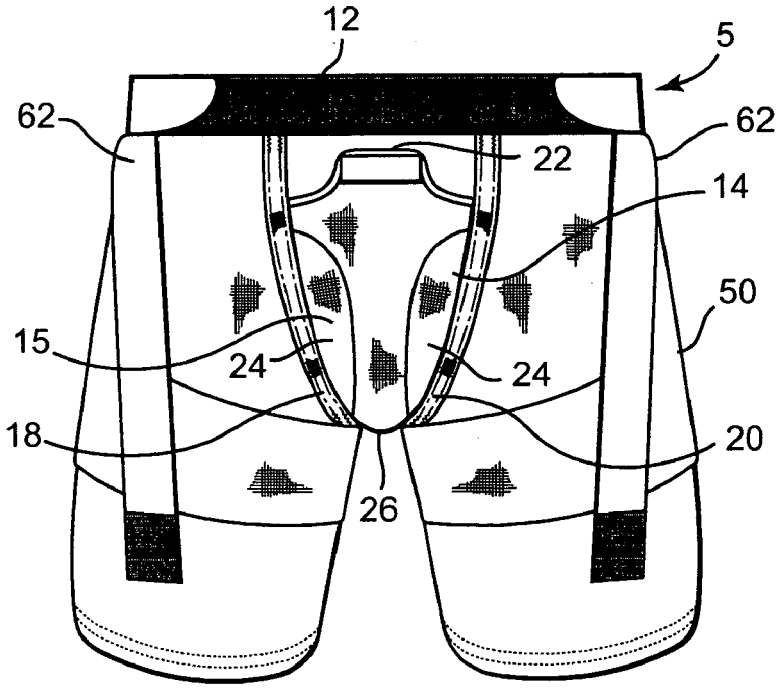
FIG. 12 illustrates a front view of a support short according to an embodiment of the present invention.

FIG. 12 shows a further embodiment which replaces the hockey sock supports 60 shown in FIGS. 9–11 with garter straps 62 for supporting hockey socks. The garter straps 62 may be formed from an elastic material and may be permanently or removably attached to the waist portion 12. In one embodiment, the jock support short 5 includes at least four garter straps 62.

Figure 13:
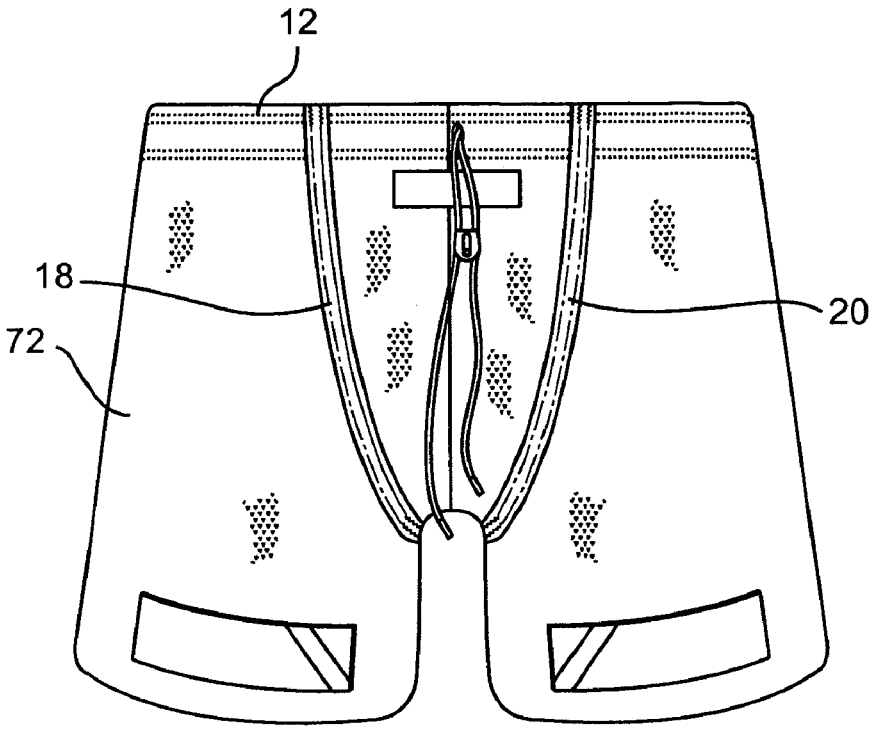
FIG. 13 illustrates a front view of a support short according to an embodiment of the present invention.

FIGS. 13–17 illustrate yet another embodiment of the present invention which includes an inner short 70 attached to an outer short 72 at waistband 12. FIG. 13 shows outer short 72 including elongate members 18, 20. The elongate members 18, 20 may extend along the outer short 72 similarly to the embodiments shown in FIGS. 1–12. Alternatively, the elongate members 18, 20 may only extend along the front of the outer short 72, and/or may serve only decorative purposes. In a further embodiment, the outer short member does not include elongate members 18, 20.

The outer short 72 may be formed from either a loose fitting or a compression material. Outer short 72 and may further include padding layers 50, 50 and/or hockey sock supports 60 as shown in FIGS. 6–12.

Figure 14:
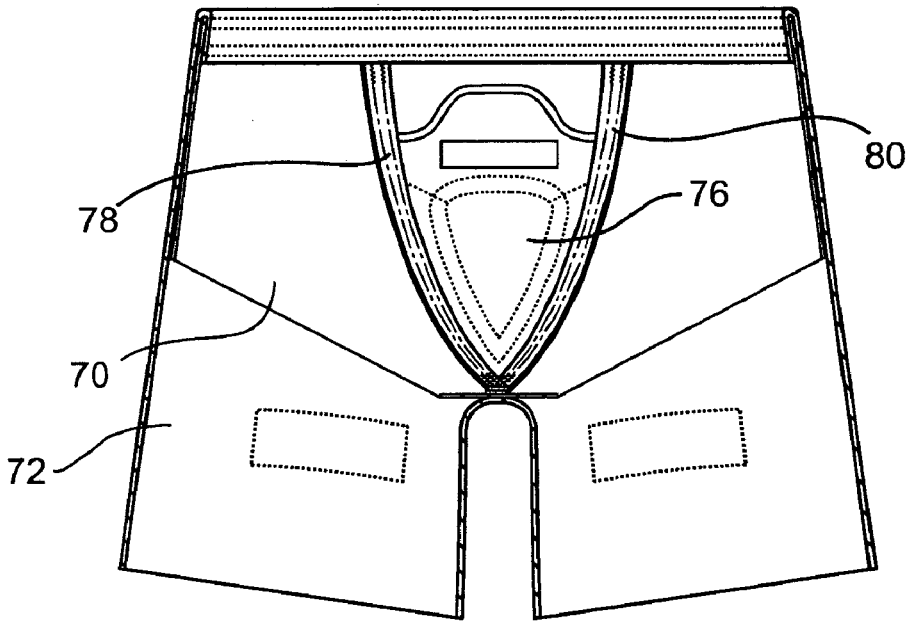
FIG. 14 illustrates a cross-sectional front view of an inner short portion of the support short shown in FIG. 13.
Figure 15:
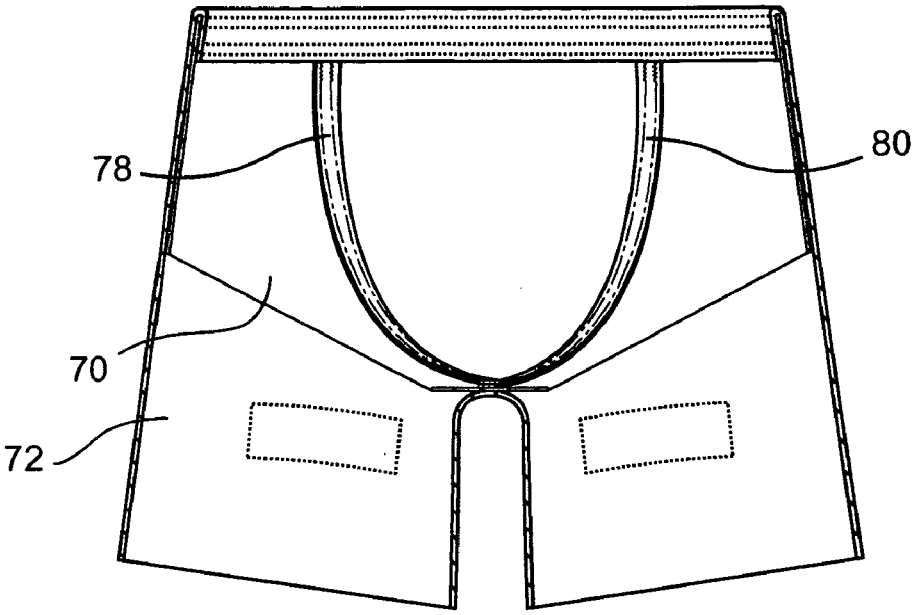
FIG. 15 illustrates a cross-sectional rear view of an inner short portion of the support short shown in FIG. 13.
Figure 16:
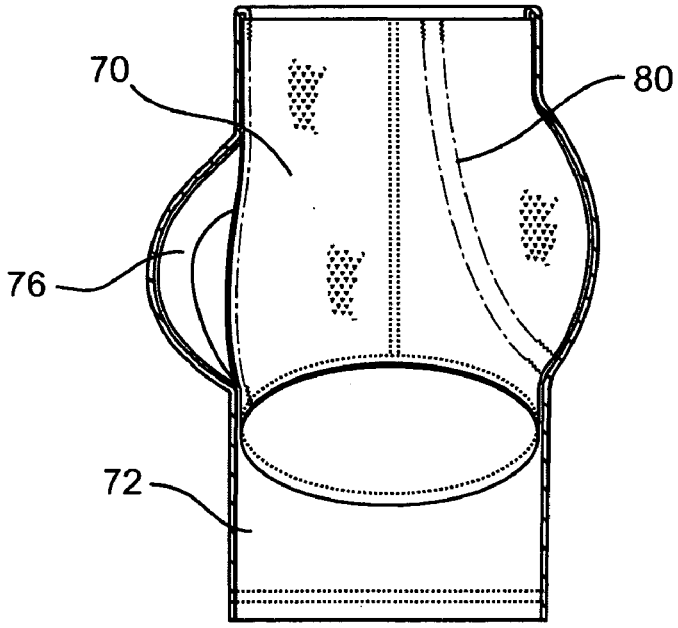
FIG. 16 illustrates a cross-sectional side view of an inner short portion of the support short shown in FIG. 13.
Figure 17:
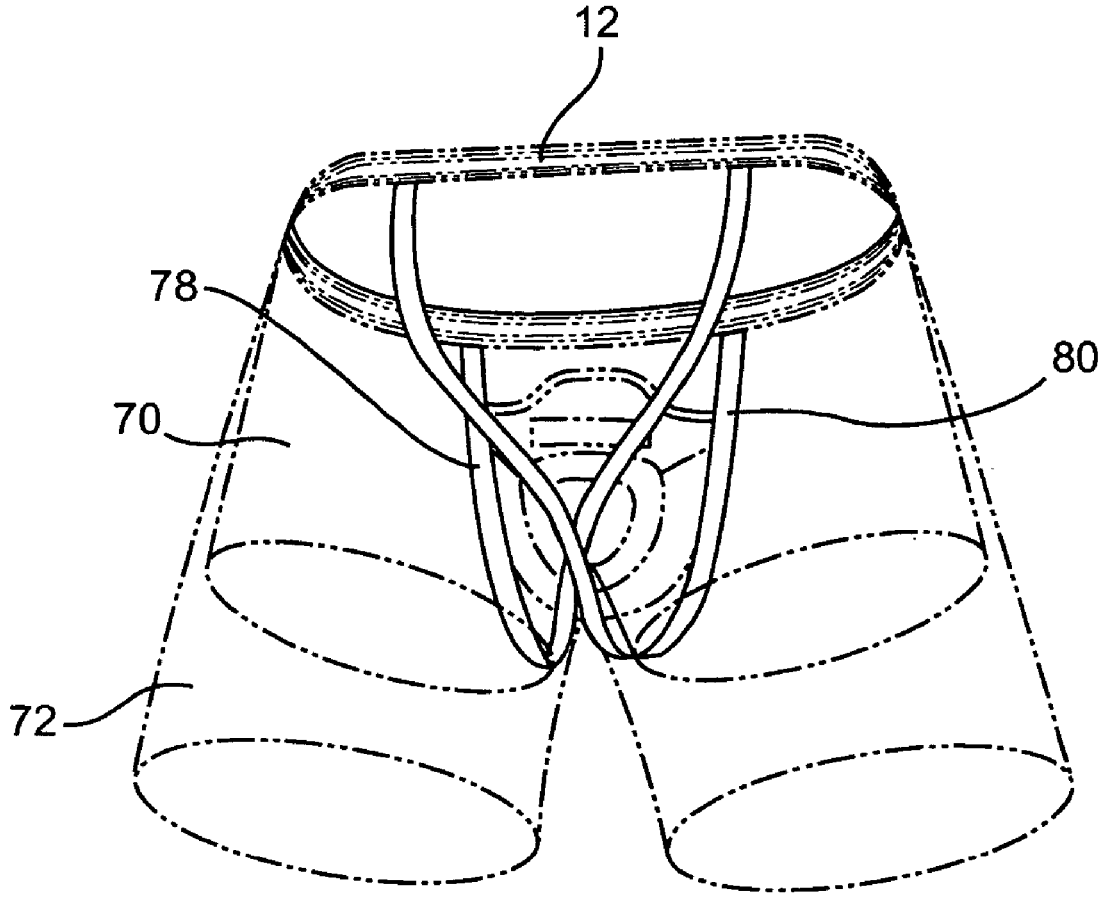
FIG. 17 illustrates a perspective view of an inner short portion of the support short shown in FIG. 13.

Inner short 70 may be substantially free-moving relative to the outer short 72. FIGS. 14–16 show respective front, rear and side cross-sectional views of the support short 5. As further shown in FIG. 14, the pocket 76 and elongate members 78, 80 are formed on an inside surface of the inner short 70 such that the cup is secured and retained over a user's groin. As shown in FIG. 17, the elongate members 78, 80 are configured in an "X" configuration similar to the elongate members 18, 20 shown in FIGS. 1–12.

As is evident from the foregoing, the present invention may be used for a variety of athletic activities, including baseball, hockey, football, basketball, soccer and the like, as well as certain occupational and other non-athletic activities. The various features reported in the illustrated embodiments may be added, eliminated or combined in a variety of ways for use with or in a particular application.

I claim:

1. A jock support short comprising:

a short member including front and rear portions integrally formed to define a waist portion and first and second leg portions; and an integral jock support member including:

a pocket portion attached to the front portion of the short member for housing a protective cup adjacent the groin of a user, and at least two elongate members which extend generally downwardly adjacent the pocket portion, between the first and second leg portions, and along the rear portion of the short, wherein the at least two elongate members restrict movement of the pocket portion relative to the short member.

2. The support short of claim 1 wherein the pocket portion includes an open top side for inserting a protective cup and closing means for closing the open top side.

3. The support short of claim 1 wherein the integral jock support member is disposed either on an inside or outside surface of the short member.

4. The support short of claim 1 further comprising a protective cup housed within the pocket.

5. The support short of claim 1 wherein the elongate members extend downwardly from the waist portion of the short member.

6. The support short of claim 1 wherein the elongate members meet or intersect at a crotch portion of the short member.

7. The support short of claim 1 wherein the elongate members comprise first and second straps.

8. The support short of claim 7 wherein the first and second straps include respective first and second ends, each end being attached to the short member at or near the waist portion, and wherein the first and second straps intersect at a crotch portion of the short member.

9. The support short of claim 1 further comprising padding layers disposed on an outside or inside surface of the short member.

10. The support short of claim 1 further comprising a plurality of hockey sock engagement members disposed on the outside or inside of the short member.

11. The support short of claim 10 wherein the hockey sock engagement members comprise a plurality of straps having a first end attached to the waistband portion of the short member and a second end for attachment to a hockey sock.

12. The support short of claim 10 wherein the hockey sock engagement members comprise connective flaps attached to the leg portions of the short member.

13. The support short of claim 1 wherein the short member includes an inner short member and an outer short member, and wherein the integral jock support member is attached to the inner short member.

14. A jock support short comprising: a short member including a first leg portion, a second leg portion and a pocket portion adapted to receive a protective jock cup, wherein the pocket portion is attached to the first and second legs of the short member; and means for restricting movement of the pocket portion relative to the first and second leg portions.

15. The support short of claim 14 wherein the means includes a pair of elongate fabric members extending along opposing sides of the pocket portion.

16. The support short of claim 14 wherein the means includes a pair of elastic straps extending along opposing sides of the pocket portion.

17. The support short of claim 14 wherein the means includes a pair of tension threads extending along opposing sides of the pocket portion.

18. A jock support short comprising:

an outer short member including front and rear portions integrally formed to define a waist portion and first and second leg portions; and an inner short member attached to the waist portion of the outer short member, and an integral jock support member formed on the inner short member which includes a pocket portion for housing a protective cup adjacent the groin of a user and at least two elongate members which are adapted to restrict movement of the pocket portion relative to the inner short member.

19. The support short of claim 18 wherein the outer short comprises a loose-fitting material and the inner short comprises a compression material.

20. The support short of claim 18 wherein both the inner and outer short comprise a compression material.

21. The support short of claim 18 further comprising two elongate members disposed on the outer short member which extend generally vertically along the front of the short, between the first and second leg portions, and along the rear portion of the short member.

* * * * *